US005758441A

United States Patent [19]

Law

[11] Patent Number: 5,758,441

[45] Date of Patent: Jun. 2, 1998

[54] DISPLAY ASSEMBLY

[76] Inventor: William Edward Law, 1180 Lovers La., Tallahassee, Fla. 32311

[21] Appl. No.: 538,120

[22] Filed: Oct. 2, 1995

[51] Int. Cl.[6] ..... G09F 7/00

[52] U.S. Cl. ..... 40/492; 40/205; 40/211; 40/591

[58] Field of Search ..... 40/200, 202, 204, 40/205, 209, 211, 492, 564, 591, 643, 747

[56] References Cited

U.S. PATENT DOCUMENTS

| | | | |
|---|---|---|---|
| 874,998 | 12/1907 | Schumacher | 40/597 |
| 1,080,631 | 12/1913 | Havemeyer | 40/211 |
| 1,363,893 | 12/1920 | Merkle | 40/200 X |
| 1,506,492 | 8/1924 | Larsen | 40/205 |
| 1,923,310 | 8/1933 | Hippold | 40/202 X |
| 2,104,230 | 1/1938 | Kiss | 40/204 |
| 2,888,763 | 6/1959 | Roycroft, Jr. | 40/492 X |
| 4,413,803 | 11/1983 | Ross | 40/209 X |
| 4,860,476 | 8/1989 | Hall | 40/597 |
| 4,903,423 | 2/1990 | Hinca | 40/205 |
| 5,241,968 | 9/1993 | Thompson | 40/597 |

*Primary Examiner*—Brian K. Green
*Attorney, Agent, or Firm*—Carnes, Cona and Dixon

[57] ABSTRACT

A display assembly is provided which will display a brightly lit message or design. The display assembly is particularly appropriate to show support for athletic teams. The display assembly is comprised of a frame which supports a message unit. The message unit is internally coated with a highly reflective material and includes a light source, a translucent colored lens imprinted with an image or design, and a clear lens cover to protect display assembly from moisture and road dirt. Both the clear protective lens cover and the colored transparent lens may be easily removed to allow the light source to be changed and the colored translucent lens to be exchanged.

7 Claims, 6 Drawing Sheets

DISPLAY ASSEMBLY

BACKGROUND OF THE INVENTION

1. Field of the Invention

The present invention relates generally to a display assembly for automobiles and more particularly to a display assembly that is adapted to be removably secured to the front tag holder or dashboard of a vehicle, in order to display a lighted message or design.

2. Description of the Prior Art

For many years people have displayed front tags that carry a message or show support for a sports team. Traditionally these tags have consisted of a metal or plastic sheet with the message painted or stamped on the tag. Messages have also been displayed as bumper stickers, signs hanging in the rear window, and decals. Accordingly, efforts have been expended to make these messages even more eye catching and versatile.

Such a device is disclosed in U.S. Pat. No. 874,998 issued to Schumacher. Schumacher discloses a rotatable license plate frame. This device consists of a wire hanger bent to form pivot points which are inserted into a rectangular plate or board. The edges of the board are grooved and the ends of the hanger are bent so as to spring within the groove, locking the board in place and preventing accidental rotation. This device, though efficient, does suffers some drawbacks. One drawback is that the device must be completely removed and then rotated in order to display the desired message. Further, this device does not disclose a light fixture or any type of lighting means for providing the message to be visually displayed at night. Yet another drawback is that this device does not include an anti-theft means for preventing the burglarization of the device.

Another device is disclosed in U.S. Pat. No. 4,860,476 issue to Hall. Hall discloses an illuminated message unit that mounts on an automobile dashboard. This device is eye-catching, however, the message is displayed via perforations in a solid board. This manner of display provides for a device that is limited in versatility as well as providing for a device who's message or illustration is not very vivid and eye-catching.

Yet another device is disclosed in U.S. Pat. No. 5,241,786 issued to Thompson. Thompson discloses a message display unit that is mounted via suction cups to the automobile's window. Thompson device is not illuminated and hence is not as visual during the evening.

None of these previous efforts, however, provide the benefits intended with the present invention, such as providing a display device that will display a message or illustration in an artistic, eye-catching manner which is both versatile and practical. Additionally, prior techniques do not suggest the present inventive combination of component elements as disclosed and claimed herein. The present invention achieves its intended purposes, objectives and advantages over the prior art device through a new, useful and unobvious combination of component elements, which is simple to use, with the utilization of a minimum number of functioning parts, at a reasonable cost to manufacture, assemble, test and by employing only readily available material.

SUMMARY OF THE INVENTION

The present invention provides for a display assembly which will enable the display of brightly lit images or messages in color. This type of displaying means is particularly appropriate to show support for athletic teams or the like. The display assembly is adapted to be secured to the front tag holder of automobiles and uses the vehicle's battery system to provide electrical power. Optionally, the unit may be battery powered.

The display assembly of the present invention comprises a lighted message unit and mounting frame. The lighted message unit internally includes a back panel coated with a highly reflective material, a light source, a transparent colored lens having an imprinted image or message, and a clear lens cover for protecting the display assembly from dirt, moisture, and the like.

The mounting frame is secured to the front of an automobile via an attaching means, such as screws. These screws can be designed to include unique heads so as to prevent vandalism or auto theft. This mounting frame maintains the lighted message unit of present invention and permits for the display assembly to function as a two sided display unit, wherein the lighted message unit can be rotated for displaying a traditional tag, which is secured to the back surface of the display assembly, or can be rotated for displaying the illuminated message or design.

The mounting frame is an inverted U-shape that includes a shaft and two side arms attached on the opposite ends of the shaft. The shaft is covered by a tube on which are mounting brackets. The shaft is adapted to rotate about the tube in order to provide for the arm to extend outwardly in an adjusting position or downwardly in a displaying position.

The shaft is secured into these position via a stopping means. The stopping means includes a spring loaded pin that is secured to the shaft. The tube includes a pair of openings that are vertically aligned. These holes are adapted to receive the spring loaded pin. Once received in one of the holes, the frame is in a fixed position, either in the adjusting or displaying position.

The upward location of the arms will provide for the arms to extend outwardly from the vehicle. This will provide for an efficient amount of clearance to exist between the vehicle and the lighted message unit in order to permit for the rotation of the lighted message unit. For added security, the frame may be locked and unlocked by the use of a key. For persons wishing only to use the lighted message unit, the lighted message unit may be mounted directly on to the frame using either reinforced metal brackets or recessed screws.

To utilize the display assembly, the arms of the frame are moved upward to provide for the arms to extend outwardly from the frame. The lighted message unit is rotated to a desired position of either displaying the lighted message or displaying the back surface of the lighted message unit. The arms are then moved downward to provide for the arms to extend downwardly from the shaft. If the lighted message is displayed then the display assembly is activated.

Another embodiment of the device allows the mounting of the display assembly on the dashboard via a non-slip pad and/or suction cups.

Accordingly, it is the object of the present invention to provide for a display assembly which will brightly and effectively display a message or design on the front of an automobile.

It is an another object of the present invention to provide for a display assembly which includes a colored transparent lens imprinted with the message or image that can be easily removed and exchanged.

It is yet another object of the present invention to provide for a display assembly that includes a clear protective lens cover which will protect the light device from moisture, dirt, and debris.

It is yet another object of the display assembly of the present invention which can easily be disassembled so as to permit the removal or repair of any of the components of the display assembly.

Still a further object of the present invention is to provide a display assembly which will overcome the deficiencies, disadvantages, and shortcomings of the prior art.

A final object of the present invention is to provide a display assembly in accordance with the preceding objects which will conform to conventional forms of manufacture, be simple to construct and easy to use so as to provide a device that would be economically feasible, long lasting and relatively trouble free in operation.

Although there have been many inventions related to automobiles display devices, none of the inventions have become sufficiently compact, low cost, and reliable enough to be commonly used. The present invention meets the requirements of simplified design, compact size, low initial cost, low operating cost, is easy to install and maintain, and requires only a minimal amount of training to successfully employ the invention.

The foregoing has outlined some of the more pertinent objects of the invention. These objects should be construed to be merely illustrative of some of the more prominent features and applications of the intended invention. Many other beneficial results can be obtained by applying the disclosed invention in a different manner or modifying the invention within the scope of the disclosure. Accordingly, a fuller understanding of the invention may be had by referring to the detailed description of the preferred embodiments in addition to the scope of the invention defined by the claims taken in conjunction with the accompanying drawings.

BRIEF DESCRIPTION OF THE DRAWINGS

Similar reference numerals refer to similar parts throughout the several views of the drawings.

DESCRIPTION OF THE PREFERRED EMBODIMENTS

Figure 1:
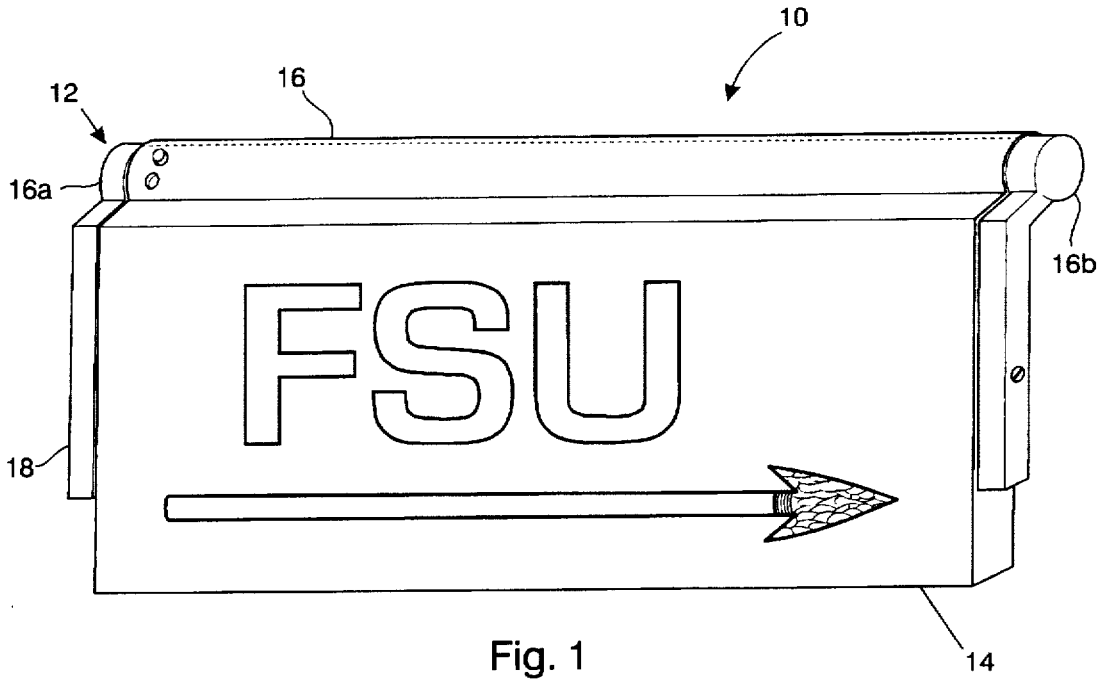
FIG. 1 is a perspective view of the display assembly of the present invention.

As illustrated in FIG. 1, the display assembly 10 of the present invention includes a mounting frame 12 which maintains and secures the lighted message unit 14. The mounting frame 12, as illustrated, is an inverted U-shape structure. This frame 12 includes a shaft 16 wherein arms 18 are secured to the opposite ends 16*a* and 16*b* of the shaft. These arms are integral with the shaft.

Figure 2A:
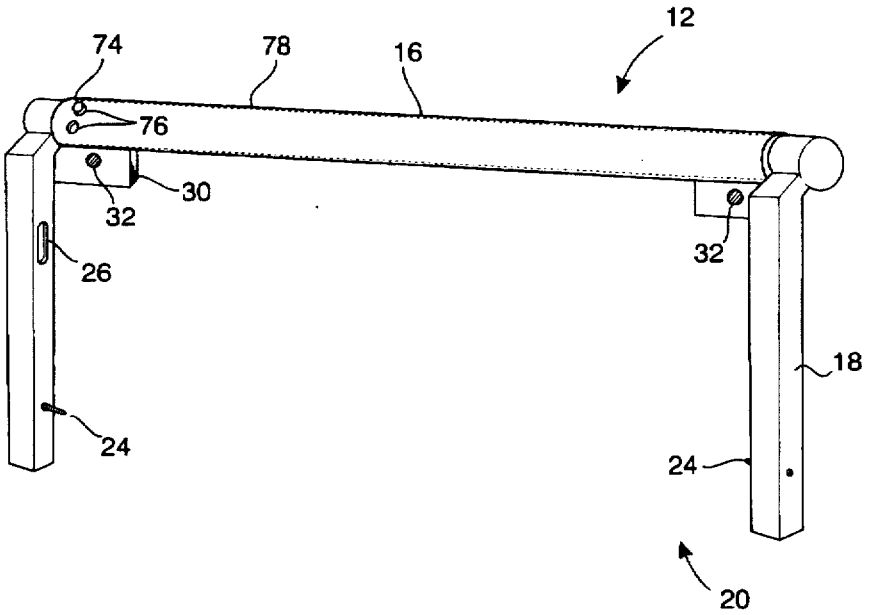
FIG. 2*a* is a perspective view of the mounting frame used for the display assembly of the present invention in a displaying position.
Figure 2B:
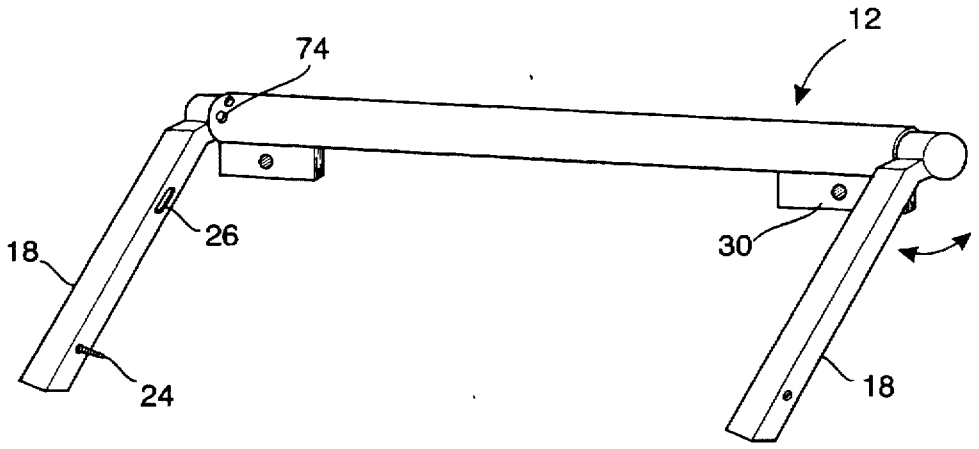
FIG. 2*b* is a perspective view of the mounting frame used for the display assembly of the present invention in an adjusting position.
Figure 2C:
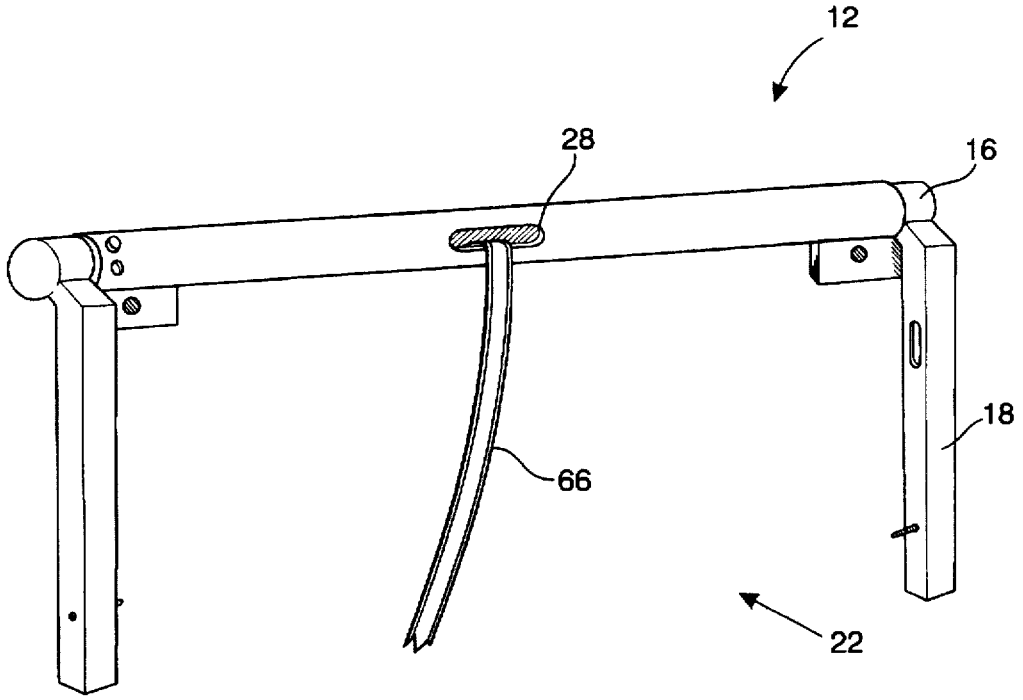
FIG. 2*c* is a rear perspective view of the mounting frame used for display assembly of the present invention.
Figure 2D:
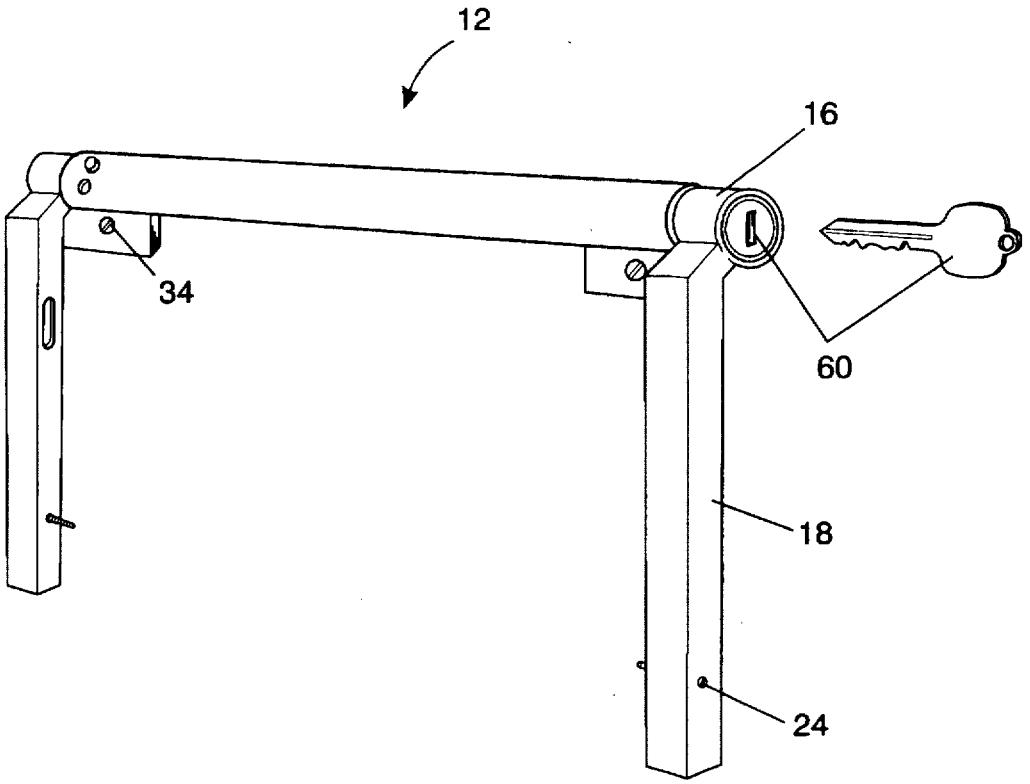
Fig. 2*d* is a perspective view of the mounting frame used for the display assembly of the present invention showing the optional key lock.

The mounting frame is illustrated in further detail in FIGS. 1, 2*a*–2*d* and 4. As seen in these figures, the frame 12 includes a front portion 20 and a back portion 22. The back portion 22 communicates with the fender of a conventional motor vehicle once the display assembly 10 is secured to the vehicle. The frame is structured as a U-shape and the arms 18 are secured to the shaft 16 at points 16*a* and 16*b*. This design and configuration will permit for the arms to be located downwardly and in a displayed position, as illustrated in FIGS. 2*a*, 2*c*, and 2*d* so as to enable for the support frame 12 to adequately display the unit 14. Additionally, the arms 18 are also adapted to extend outwardly (see FIG. 2*b*) and perpendicularly from the vehicle in order to be in an adjusting position, so as to permit for the unit 14 to be rotated. Permitting the arms to be lifted upwards provides for a sufficient amount of clearance to exists between the vehicle and the display unit 14, inherently providing the display unit to rotate. To prevent vandalism, the frame can be locked in a secured and downward position via a conventional locking mechanism 60 (shown FIG. 2*d*).

Located on the shaft 16 and between the ends of the shaft 16*a* and 16*b* is a tube or cover 78. This tube or cover 78 includes a pair of openings 76. The shaft 16 includes a spring loaded button 74 that is adapted to be received in the openings 76. These openings are aligned vertically and will admit passage of the spring loaded pin 74. This will inherently secure the mounting frame in a fixed position. Each opening represents a position for the frame. The lower opening permits for the frame to be in an adjusting position to enable the rotation of the lighted message unit 14, while the upper opening provides for the frame to be in a display position, enabling the lighted message unit to be on display. Hence to move the arms 18, the user merely pushes down on the button and rotates the arms to a desired location. Once the spring loaded button 76 emerges from one of the opening, then the arms 18 are in a fixed position.

Located inside and at a bottom end of each arm 18 is a rigid pin 24. This rigid pin is adapted to receive and maintain the lighted message unit 14 and permits for the lighted message unit to rotate about this pin 24. This pin is also adapted to be removed from the frame, accordingly, this pin can be a conventional cap screw, as illustrated.

Also located inside each arm 18 is an electrical contact point 26. This electrical contact point 26 will permit and enable the unit 14 to be couple to an electrical wiring line 66. This wiring line 66 is located within the frame 12 and exits the frame and tube via opening 28. This opening 28 enables the wiring line 66 to be located behind the display assembly 10, thereby providing for the wire to be inconspicuous. A clear flat plastic covered wire, as illustrated in these figures as the wiring line 66, is ideally suited to this purpose for aesthetic reasons. Alternatively, the power may be supplied to the unit 14 via batteries (not illustrated) which would be adapted to be removably secured interiorly within the frame 12.

Brackets 30, located at the inner corners of the frame 12, includes openings 32 which are adapted to receive a screw-like rod 34 (see FIG. 2*d*) for providing a means of securing the display assembly 10 onto the vehicle.

Figure 3A:
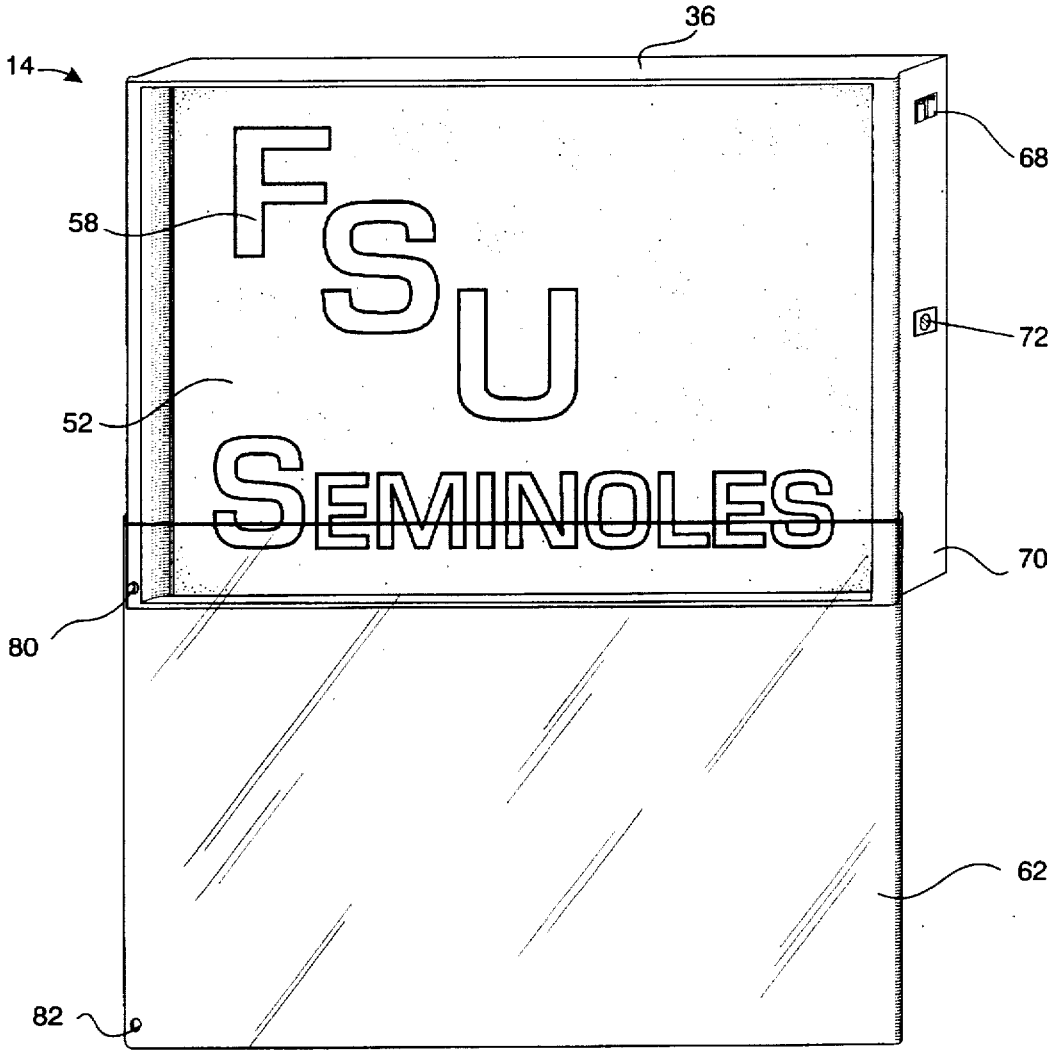
Fig. 3*a* is a perspective view of the lighted message unit used for the display assembly of the present invention prior to the attachment of the protective covering.
Figure 3B:
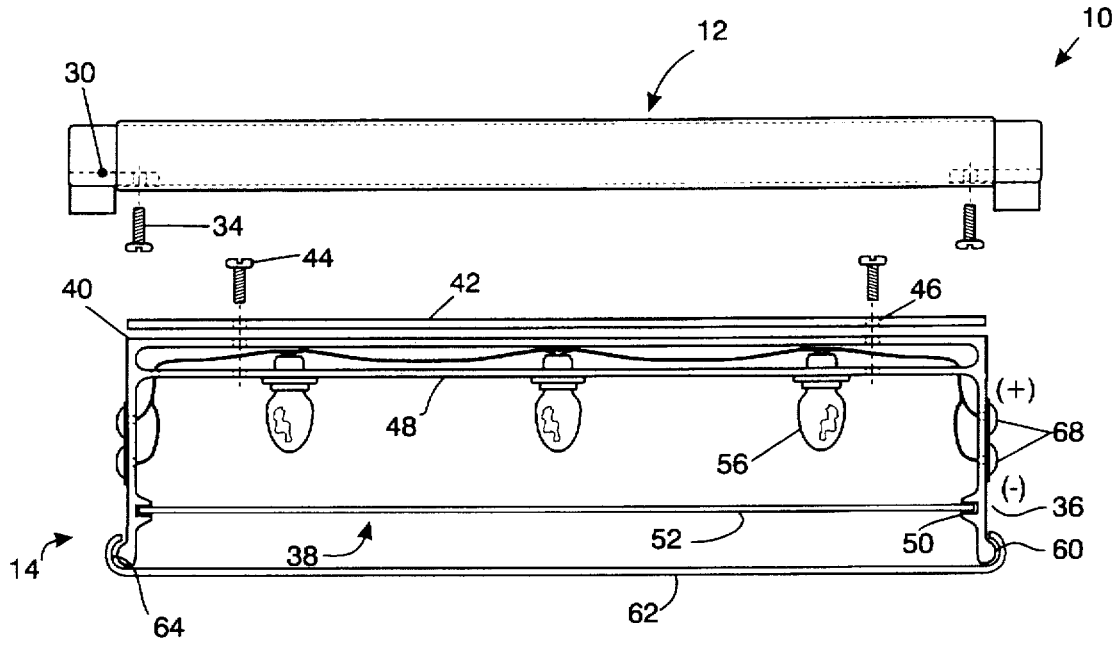
Fig. 3*b* is a top planar view of the lighted message unit used for the display assembly of the present invention, prior to assembly.
Figure 3C:
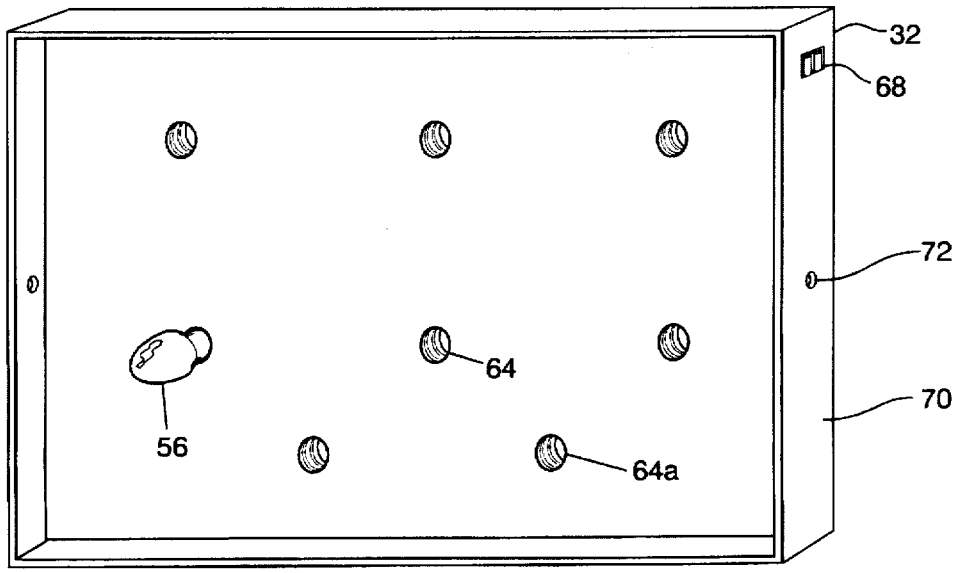
FIG. 3*c* is a perspective view of the interior of lighted message unit used for the display assembly of the present invention.
Figure 4:
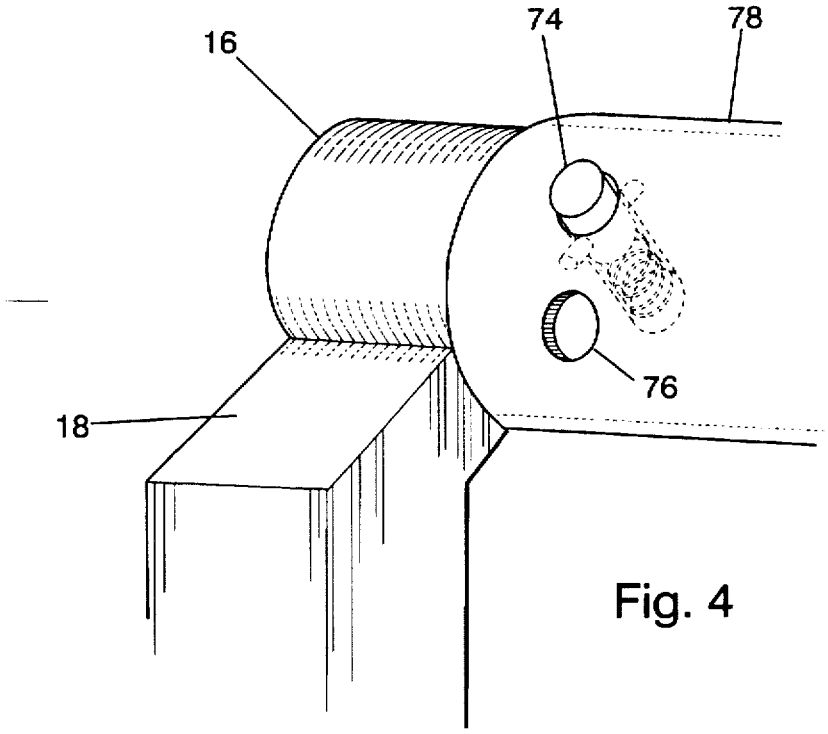
Fig. 4 is an enlarged view of the pivotal mechanism used in the display assembly of the present invention.

The lighted message unit is illustrated in further detail in FIGS. 1 and 3*a*–3*b*. As seen in these drawings, the lighted message unit 14 includes a housing 36. This housing 36 is weather resistant and can be fabricated from any durable material, such as, but not limited to plastic or aluminum.

This housing has an opened front 38 and an enclosed back 40. This enclosed back is adapted to receive a conventional tag 42 or the like and as seen in the drawings, is flat and planar. This will provide for the lighted message unit 14 to include a front side for displaying a lighted message and a back side for optionally displaying a conventional tag. If a tag is used, the tag 42 is secured to the back of the housing by way of screws 44 which are inserted into holes 46. These holes 46 extend through the conventional tag 42 and the enclosed back 40 of the housing 36. The holes 46 constitute an accepting means for accepting the tag.

The interior of the housing 36 is coated with a reflective material 48, such as MYLAR. Optionally, this interior of the housing can be painted with a reflective paint, such as silver color paint.

Secured to the interior of the housing 36 and extending outwardly from the reflective material 48 is at least one light bulb 56. The light bulb(s) 56 can be threadably secured to the back of the housing via openings 64. Some of the openings 64 are coated with an electrical material while other openings are not conductive, such as 64*a*. These non conducting openings 64*a* act as holding receptacles for extra light bulbs. The coated openings are electrically connected to the contact point 68 located directly on the housing 36.

The housing 36 includes a slot 50 having an opened end and a closed end. The opened end of this is slot 50 is adapted to slidably receive a transparent or translucent color screen 52 and/or a pattern screen. The closed end of this slot provides for a natural stop for the screen. The translucent color screen 52 can include a pattern 58 attached thereto (pattern 58 illustrated in these figures as "FSU SEMINOLES") or optionally a pattern screen can be located in front of or behind the color screen 52. This pattern screen would be fabricated from any durable, dark, non-transparent and rigid material. A pattern 58 would extends through the screen 54 in order to provide a means of permitting the light from the bulbs 56 to shine through the pattern.

Optionally, the translucent material may be cut and secured to the back of the pattern screen This will enable a plurality of colors to be used for the unit 14. For example, the "FSU" could include a garnet color translucent material attached to the back of the pattern screen, while a gold or yellow translucent material can be attached to the back of the word "SEMINOLES".

Optionally, the color screen 52 can be fabricated from a multi-colored translucent sheeting material.

A clear protective cover 62 includes channels 64 to provide for the cover 62 to be slidably secured to the housing 36 over protrusion 60. This cover 62 is transparent and protects the unit 14 and its various components from dirt, increment weather, debris, and the like.

A stop means is used to secure the cover 62 to the housing. This stop means can include a spring loaded button 80 that is secured to the front of the pattern screen 54. This button would be adapted to be removably secured to an opening 82 located in the cover 62. Optionally, a second stop means (not illustrated) would provide for a tray or the like to extend outwardly from the lower end of the housing. This tray will provide for a natural stop for the cover 62. The stop means maintains the screens on the unit 14 and inherently prevents the cover from falling downwardly from the unit.

The housing 36 further includes side walls 70. A second set of contacts 68 are located on the side walls 70. These contacts 68 will be aligned with the contacts located on the frame once the unit 14 is secured to the frame. This will provide for an electrical communication to be established between the frame and the unit 14.

Also located on each side wall 70 of the housing 36 is an aperture 72. Each aperture is adapted to receive the rigid pin 24. This will provide for the housing 36 to be rotatably mounted on the frame.

In order to utilize the first embodiment of the present invention, the user first secures the device 10 onto the front of the vehicle via brackets 30. The spring loaded pin is depressed to enable the rotation of the shaft. This will permit for the side arms to be lifted upward. Once the pin emerges from the opposite opening, the frame will be in a fixed position. The display unit 14 is rotated via rigid bars 24 to a desired side. The button 74 is pressed again, and the side arms are shifted downward until the pin emerges. Thereby, locking the device into a secured position enabling the display of the lighted message unit 14.

The above described embodiment can be simplified to provide for the frame 12 to be secured directly to the lighted message unit 14, so that rotation is not possible. This design and configuration will provide for the only option to exists to be for the lighted message to be displayed. Hence, the tube would be eliminated, and the brackets would be secured directly to the frame. The rigid pins would be threadably secured to the light message unit so as to prohibit the rotation of the device. Accordingly, the frame would be mounted to the front of a conventional vehicle, so as to render the lighted message to be displayed.

Figure 5:
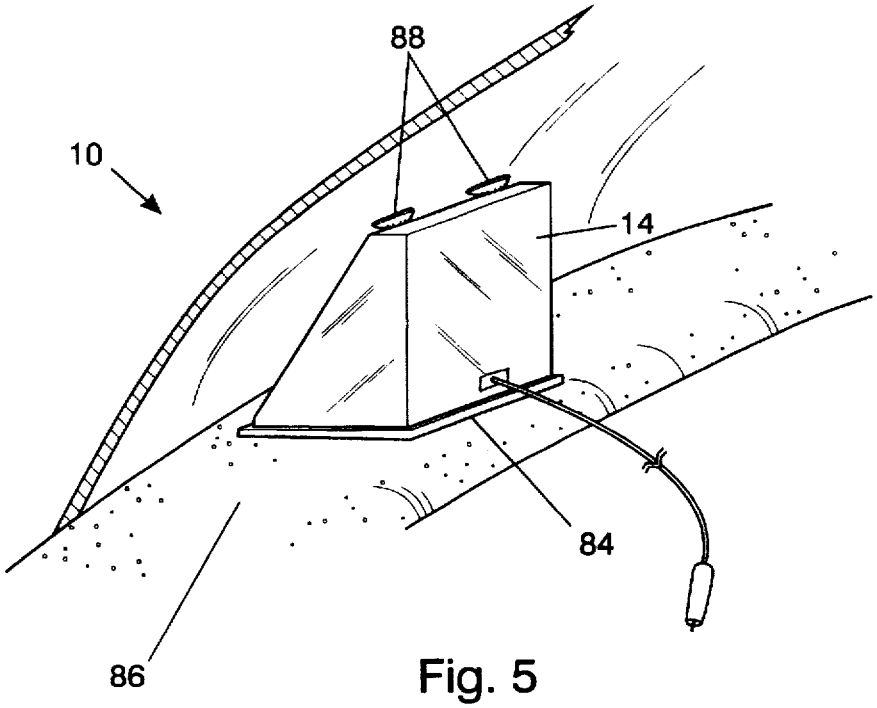
Fig. 5 is a perspective view of an alternative embodiment of the display assembly of the present invention.

In states where decorative front display units are prohibited, a smaller unit is disclosed. This unit is illustrated in further detail in FIG. 5. As seen in this figure, the unit 10 is compact and is adapted to be located on the dash board of a vehicle. This display assembly includes a rubber non-slip pad 84 that is adapted to rest on the upper surface of the dash 86 of a conventional vehicle. The lighted message unit 14 is similar in structures as the first embodiment of the lighted message unit 14, as illustrated in FIGS. 1 and 3*a* described above, except that the housing 36 is a triangular shape. Further the cover 62 can also include a plurality of suction cups 88 to permit for the display assembly to be secured to the front window of a conventional vehicle.

While the invention has been particularly shown and described with reference to an embodiment thereof, it will be understood by those skilled in the art that various changes in form and detail may be made without departing from the spirit and scope of the invention.

I claim:

1. A message display assembly comprising:

a mounting frame;

a display unit having a housing is pivotally secured to said mounting frame;

said housing includes an interior, an enclosed back and an opened front;

an illumination means is located within said interior of said housing and is secured to said enclosed back;

a pattern translucent screen is removably secured in proximity to said opened front within said housing;

said pattern translucent screen constitute a first message;

an accepting means is located on said enclosed back;

said accepting means is located exteriorly on said enclosed back surface;

wherein in a pivoted first position, said housing for enabling said housing to display said first message and said housing can be re-positioned to a pivoted second position for enabling said housing to display said second message, and said first message can be illuminated via said illumination means; and said frame includes a shaft having opposite ends and an arm is secured to each end of said shaft, said shaft is able to rotate about a tube, said arms each include a rigid bar that receives said display unit for enabling said display unit to rotate about said rigid bars, a first stop means provides for said arms to extend downward and for said display unit to be in a display position, a second stop means provides for said arms to extend outward and for said display unit to be in an adjusting position for enabling said display unit to rotate about said rigid bars.

2. A message display assembly as in claim 1 wherein a protective cover is secured to said opened front and in front of said pattern translucent screen for protecting said pattern translucent screen.

3. A message display assembly as in claim 1 wherein said interior of said display unit includes at least one storage unit for storing a spare illumination means.

4. A message display assembly as in claim 1 wherein said tube includes a first hole and a second hole aligned vertically and below said first hole, said shaft includes a spring loaded pin, said first hole and said second hole can receive said spring loaded pin, said first hole and said spring loaded pin provides for said first stop means, and said second hole and said spring loaded pin provides for said second stop means.

5. A display assembly as in claim 4 wherein said pattern translucent screen is slideably insertable into said display unit.

6. A display assembly as in claim 5 wherein said display unit is internally coated with a reflective material.

7. A display assembly as in claim 1 wherein said display unit is internally coated with a reflective material.

* * * * *